US005860877A

United States Patent [19]

Esser

[11] Patent Number: 5,860,877

[45] Date of Patent: Jan. 19, 1999

[54] ADJUSTABLE HEIGHT POST FOR A VOLLEYBALL NET, IN PARTICULAR A BEACH VOLLEYBALL NET

[75] Inventor: Ralf Esser, Hennef, Germany

[73] Assignee: Erhard Sport International GmbH & Co, Rothenburg, Germany

[21] Appl. No.: 946,215

[22] Filed: Oct. 7, 1997

[30] Foreign Application Priority Data

Oct. 11, 1996 [DE] Germany ..... 196 41 977.8

[51] Int. Cl.[6] ..... A63B 61/04

[52] U.S. Cl. ..... 473/492

[58] Field of Search ..... 473/492, 493, 473/466, 473, 575, 212

[56] References Cited

U.S. PATENT DOCUMENTS

| | | | |
|---|---|---|---|
| 3,953,029 | 4/1976 | Boyd | 473/575 |
| 4,122,451 | 10/1978 | Senoh | 473/492 |
| 4,444,397 | 4/1984 | Kaburagi et al. | 473/493 |
| 5,242,174 | 9/1993 | Koole | 473/492 |
| 5,308,085 | 5/1994 | Koole | 473/493 |

FOREIGN PATENT DOCUMENTS

| | | |
|---|---|---|
| 35 23 568 | 1/1987 | Germany . |
| 40 19 610 | 11/1991 | Germany . |

*Primary Examiner*—William H. Grieb
*Attorney, Agent, or Firm*—Browdy and Neimark

[57] ABSTRACT

In an adjustable height post for a volleyball net, in particular for a beach volleyball net, comprising a ground sleeve to be anchored in or on the ground and a net pole, which is lockable in variable positions of height and is displaceably guided in the ground sleeve, telescoping in the vertical direction, it is provided that the net pole and the ground sleeve are roller-seated relative to each other by means of bearing rollers, and that a rubber-elastic cord is mounted between the net pole and the ground sleeve, by the expansion of which a counterforce can be produced, which opposes the weight of the net pole.

8 Claims, 4 Drawing Sheets

ADJUSTABLE HEIGHT POST FOR A VOLLEYBALL NET, IN PARTICULAR A BEACH VOLLEYBALL NET

BACKGROUND OF THE INVENTION

1. Field of the Invention

The invention relates to an adjustable height post for a volleyball net and in particular for a beach volleyball net comprising a ground sleeve anchored in or on a subsoil; and a net pole, which is lockable in variable positions of height, and which is displaceably guided in the ground sleeve, telescoping in the vertical direction, the net pole and the ground sleeve being roller-seated relative to each other by means of bearing rollers.

2. Background Art

A post of the generic type is known from DE 40 19 610 A1. A similar post is described in DE 35 23 568 A1.

As everybody knows, volleyball nets—and of course also badminton nets etc.—are mounted between two posts unless other possibilities of fastening the net are available for instance in a building.

Since different net heights are required for men's and women's volleyball, the posts must be made adjustable in height. Height adjustability is important also in beach volleyball, because in this case a sand bed, the height of which can vary from case to case, is deposited on a solid subsoil. Since the post stands on the solid subsoil, the net must be adjustable in height for the required height distance of 2.50 m between the upper edge of the net and the surface of the sand bed to be set accurately.

Adjustable height posts are known to be used to this end, having a ground sleeve to be anchored in or on the ground and a net post displaceably guided in the ground sleeve, telescoping in the vertical direction, and lockable in variable positions of height.

Problems posed by the known adjustable height posts reside in the fact that a comparatively high operating force is necessitated by the sliding guide used of the pieces that are movable relative to each other. In particular, it is necessary, at the beginning of an adjusting motion, to overcome the static friction existing between the constructional elements.

Furthermore, the known height adjusting mechanisms have the drawback that when the net is fully tensioned, height adjustment is possible only at an unreasonably high expenditure of force or not at all, owing to the bearing and guide construction, because the net pole itself is braced relative to the ground sleeve by the tension of the net. In this regard, adjustment of the net height has been rather complicated and could be attained only by releasing the tension of the net, adjusting the height and then tensioning the net as before.

In connection with beach volleyball, further problems reside in the fact that the sliding mounting of the adjustable height net pole relative to the ground sleeve is highly sensitive to penetrating sand particles and dust deposits, to which it reacts by still increased operating force being needed for the vertical displacement of the net pole or even by blocking.

Finally, the net pole must be designed for corresponding stability and resistance conditioned by the high tension of the net so that the net pole itself together with the net means a considerable weight in particular when being pushed up. Since, as a rule, a locking mechanism must be released for adjustment, one would have to hold the post by one hand, which is too much for many people.

OBJECT OF SUMMARY OF THE INVENTION

Proceeding from the described prior art problems, it is the object of the invention to improve an adjustable height post of the generic type in such a way that easily displaceable guidance and mounting of the adjustable height net pole relative to the ground sleeve is attained, which is insensitive to penetrating impurities.

This object is attained by a rubber-elastic relieving cord being mounted between the net pole and the ground sleeve, by the expansion of which a counterforce can be produced, opposing the weight of the net pole. As a result of the roller seating of the net pole relative to the ground sleeve, all the drawbacks the sliding guide is accompanied with are eliminated. Fundamentally, guide rollers run a lot more smoothly than do sliding guides and they show virtually no static friction. Since, in the case of roller seating, no surfaces rub against each other during the motion of the net pole relative to the ground sleeve, penetrating impurities are no problem. Finally, the rubber-elastic relieving cord mounted between the net pole and the ground sleeve produces a counterforce which opposes the weight of the net pole and, when the cord is correspondingly designed, may even compensate the weight. In this way, the net pole can virtually be held "in suspense", any minor adjustment of height of this "suspended position" needing virtually no expenditure of force.

Preferred designs, further features, details and advantages of the invention will become apparent from the ensuing description of an exemplary embodiment of the subject matter of the invention, taken in conjunction with the drawing.

DESCRIPTION OF THE PREFERRED EMBODIMENT

Figure 1:
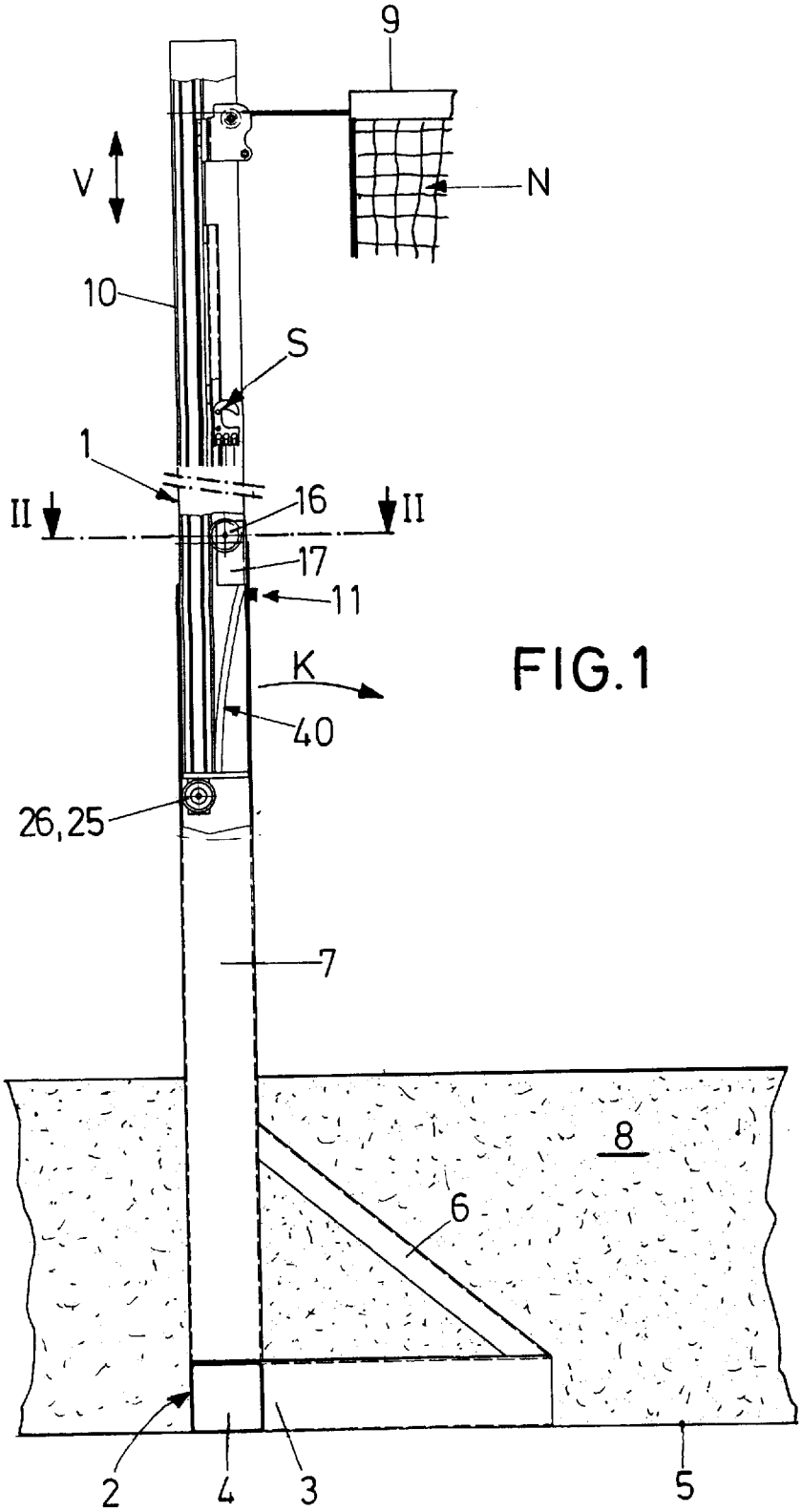
FIG. 1 is a partially sectional illustration of a lateral view of details of an adjustable height post.

As seen in FIG. 1, the adjustable height volleyball net post 1 comprises a ground understructure 2, the beams 3, 4 of which are disposed relative to each other in the shape of a T, defining a space by which the post 1 rests on the subsoil 5. By means of the reinforcing brace 6, the ground sleeve 7 located on the ground understructure 2 is supported against the tilting moment of the net N disposed at the upper end of the post 1 on a Bowden cable tensioning device S.

As further seen in FIG. 1, the subsoil 5—for instance an asphalt space—is provided with a sand bedding 8 as needed for instance for beach volleyball. For the height of the upper edge 9 of the net to be adjusted to the desired measure of 2.50 m, the post 1 is embodied to be adjustable in height, to which end the net pole 10 is displaceably guided in the ground sleeve 7, telescoping in the vertical direction V. By way of an eccentric locking mechanism 11 between the ground sleeve 7 and the net pole 10, the latter is lockable in infinitely variable positions of height.

Figure 2:
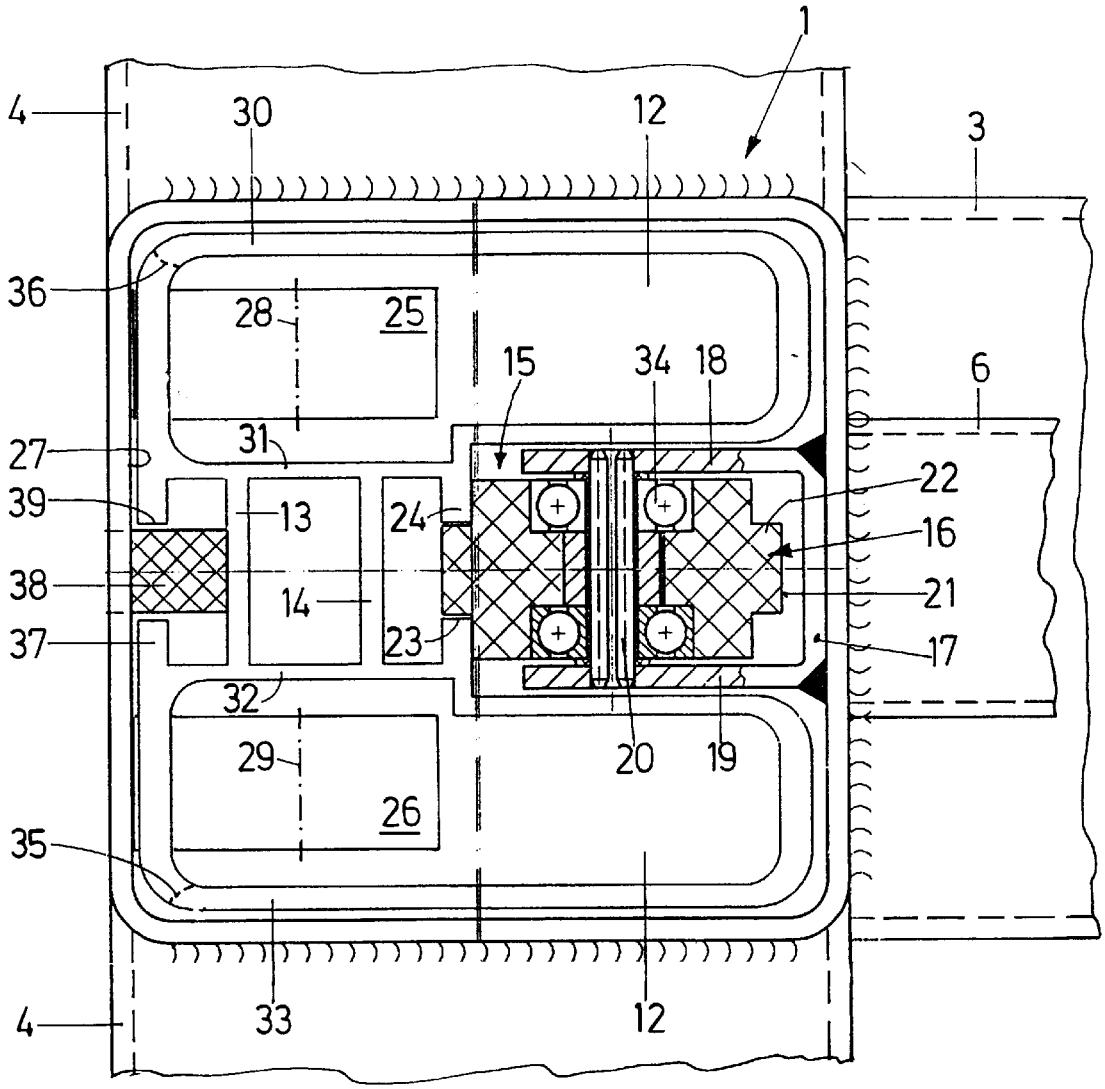
FIG. 2 is a section on the line II—II of FIG. 1.

The ground sleeve 7 is a tubular steel product representing a square section as can clearly be seen in FIG. 2. The net pole is also of substantially square contour, running in the free inner cross-section of the ground sleeve 7 with a lateral play of 4 to 5 mm.

As seen in FIG. 2, the square section of the net pole 10 comprises two substantially flat rectangular main chambers 12 which are coupled with each other by connecting ribs 13, 14 forced out laterally. As a result of this design, the net pole 10 possesses a guide passage 15 which extends length-wise, i.e. vertically, and the depth of which corresponds to approximately half the width of the section. The width of the guide passage 15 corresponds to about one third of the width of the net pole 10. A first bearing roller 16 which is fixed to the upper end of the ground sleeve 7 engages with this guide passage 15. The fastening of the bearing roller 16 is effected by a channel piece 17 which is welded on the upper end of the ground sleeve 7 and located in the free inner cross-section of the sleeve. The bearing roller 16 is run on an axle 20 on such part of the channel piece 17 which slightly stands out upwards from the ground sleeve 7 and between the two cheeks 18, 19 of the channel piece 17. The running tread 21 of the bearing roller 16 is stepped, the ring projection 22 formed thereby running in a gap 23 in the bottom 24 of the guide passage 15.

As further diagrammatically outlined in FIG. 1 and as seen in FIG. 2, a pair of bearing rollers 25, 26 are located at the lower end of the net pole 10 on the latter's exterior turned away from the net N; they run on the inside wall 27, on the side of the exterior, of the ground sleeve 7. In the same way as the bearing roller 16, these bearing rollers 25, 26 are run on axles 28, 29 between the cheeks 30, 31 and 32, 33, respectively, of the two main chambers 12 by way of ball bearings 34. The two bearing rollers 25, 26 reach through two recesses 35, 36 at the lower end of the cheek 37, on the side of the exterior, of the net pole.

As is to be explained on the basis of FIG. 1, the tilting moment K produced by the net pole 10 causes the net pole 10 to support itself by its bearing rollers 25, 26 on the inside wall 27 of the ground sleeve 7 and by the bottom 24 of the guide passage 15 on the bearing roller 16 of the ground sleeve. Excellent roller seating takes place during height adjustment with the net fully tensioned, this ensuring smooth adjustment.

Any rubbing contact between the inner surfaces of the ground sleeve 7 and the outer surfaces of the net pole 10 is further prevented by a spacer bar 38, which is fixed to the inside wall 27 of the ground sleeve 7 to extend in the vertical direction V, and which reaches through a gap 39 in the outer cheek 37 of the net pole 10 as far as to the connecting rib 13. In this way the powder coating of the net pole is protected from being scratched.

Figure 4:
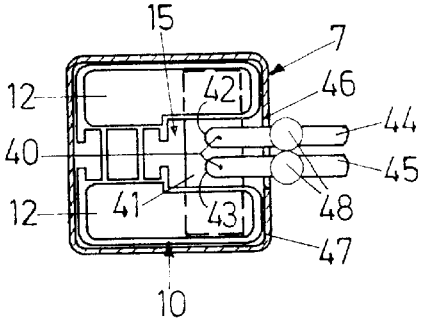
FIGS. 4 and 5 are horizontal sections on the lines IV—IV and V—V of FIG. 3.
Figure 5:
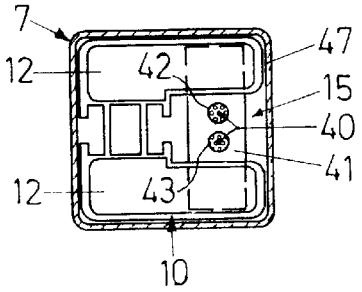
Figure 3:
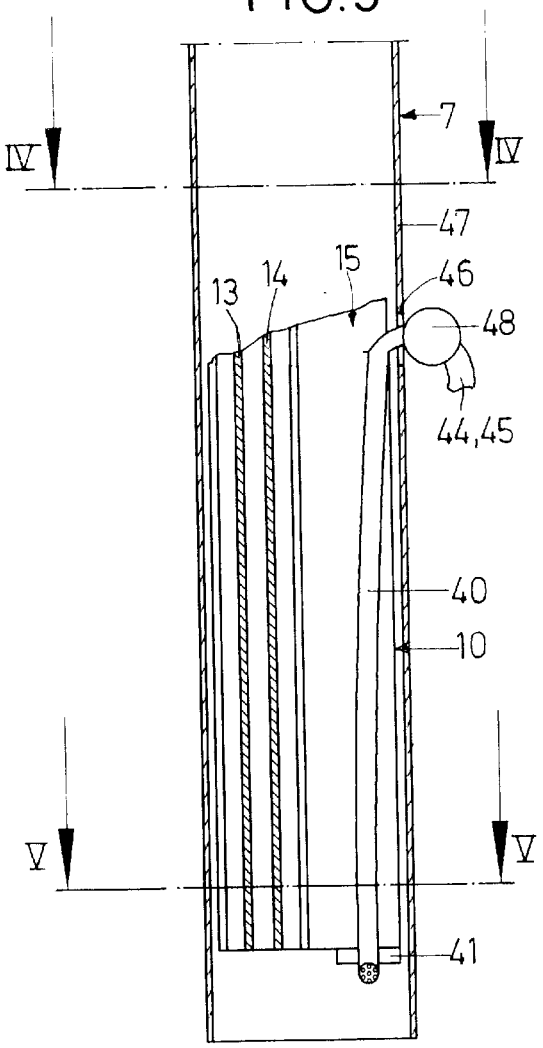
FIG. 3 is a diagrammatic view of a vertical section of the post for illustration of the course of the relieving cord.

FIG. 1 roughly diagrammatically outlines the rubber-elastic relieving cord 40 which is mounted between the net pole 10 and the ground sleeve 7. For a more detailed description, reference is made to FIGS. 3 to 5:

Fundamentally, the relieving cord 40 is a rubber cord as it is known from bungee jumping, which has a linear extensibility of more than 300%. The cord is double-cord-guided, the lower end of the cord, for fixation to the net pole 10, being deflected via a catcher plate 41. To this end, two holes 42, 43 are provided side by side in the catcher plate 41, through which the relieving cord 40 is threaded. The two free ends 44, 45 of the cord pass through a hole 46 in the ground sleeve 7 side wall 47 turned towards the net. So-called "tensioning olives" 48 are placed on the free ends 44, 45; they can be fixed in variable positions on the relieving cord 40.

The function of the relieving cord 40 is explained as follows:

Prior to the insertion of the net pole 10 in the ground sleeve 7, the relieving cord 40 together with the catcher plate 41 is placed inside the ground sleeve 7. When the net pole 10 is slipped in, the relieving cord 40 is situated within the guide passage 15, and the catcher plate 41 is taken along by the lower end of the net pole 10, which takes place virtually in any position of the catcher plate 41 and thus automatically. When the net pole is slipped into the ground sleeve 7, the relieving cord 40 expands, building up a counterforce to the weight of the net pole 10, which thus appears to have less weight or no weight at all. If the counterforce is too low in a certain position of the net pole 10, the relieving cord 40 can be shortened by displacement of the "tensioning olives" 48. The same correction mechanism can also be employed when the relieving cord 40 slackens during permanent load.

Figure 6:
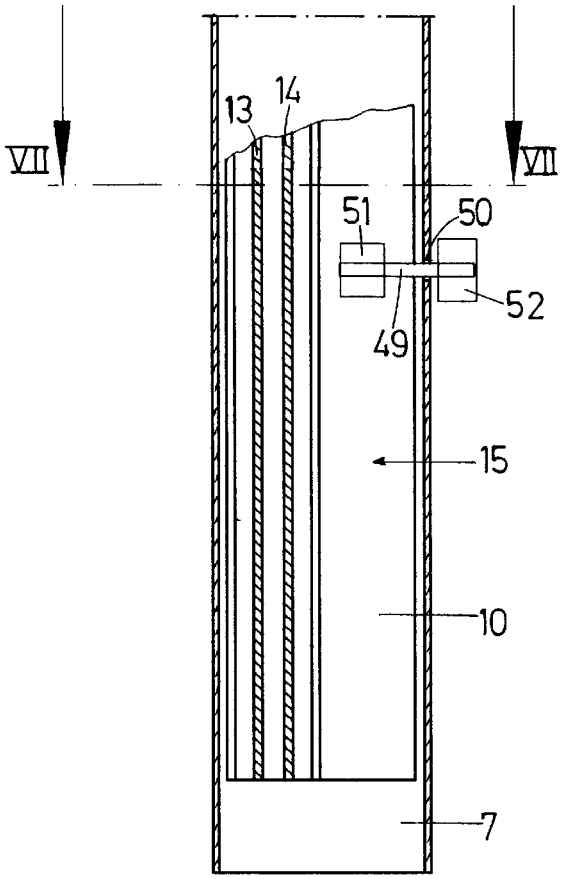
FIG. 6 is a diagrammatic view of a vertical section of the post for illustration of the locking mechanism.
Figure 7:
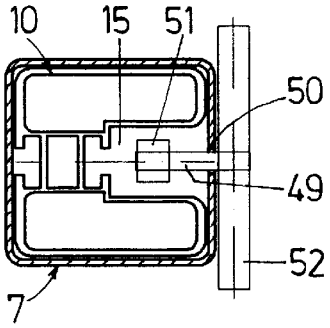
FIGS. 7 and 8 are horizontal sections through the post on the line VII—VII of FIG. 6 with the eccentric arrangement in a released and a clamped condition.
Figure 8:
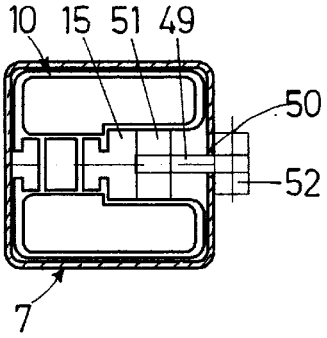

The eccentric locking mechanism 11 is explained, based on FIGS. 6 to 8. It comprises an eccentric shaft 49 which is disposed in a bearing 50 in the side wall 47 of the ground sleeve 7 above the insertion hole 46 for the relieving cord 40. A double eccentric head 51 lodges on the inner end of the eccentric shaft 49 and is located in the guide passage 15. An operating handle 52 is disposed on the outer end of the eccentric shaft 49.

From the released position seen in FIG. 7, the operating handle 52 only has to be rotated by 90° and the double eccentric head 51 acts on the two cheeks 37' of the guide passage 15. The double eccentric head 51 has the effect of clamping in both directions so that any inadvertent displacement upwards as well as downwards is effectively precluded.

What is claimed is:

1. An adjustable height post for a volleyball net, in particular for a beach volleyball net, comprising a subsoil-(5)-anchored ground sleeve (7); and a net pole (10), which is lockable in variable positions of height, and which is displaceably guided in the ground sleeve (7), telescoping in a vertical direction (V), the net pole (10) and the ground sleeve (7) being roller-seated relative to each other by means of beating rollers (16; 25, 26), wherein a rubber-elastic relieving cord (40) is mounted between the net pole (10) and the ground sleeve (7), by the expansion of which a counter-force can be produced, opposing the weight of the net pole (10).

2. A post according to claim 1, wherein the ground sleeve (7) is a square section in which runs the net pole (10) likewise of substantially square contour.

3. A post according to claim 2, wherein the net pole (10), on its inside turned towards the net, comprises a guide passage (15), which runs in the longitudinal direction and with which engages a bearing roller (16) of said bearing rollers for the net pole (10) disposed at the upper end of the ground sleeve (7).

4. A post according to claim 1, wherein the net pole (10), on its exterior turned away from the net, comprises a pair of bearing rollers (25, 26) of said bearing rollers running on the ground sleeve inside wall (27).

5. A post according to claim 3, wherein the relieving cord (40) is inserted below the ground sleeve bearing roller (16) into the interior of the ground sleeve (7) and extends in the guide passage (15) of the net pole (10) and is fixed at the lower end of the net pole (10).

6. A post according to claim 5, wherein the relieving cord (40) is double-cord-guided and, for fixation, is deflected at the lower end of the net pole (10) via a catcher plate (41).

7. A post according to claim 5, wherein at least one end (44, 45) of the relieving cord (40) that emerges from the ground sleeve (7) is equipped with fixing elements (48) to be variably positioned.

8. A post according to claim 1, wherein the net pole locking mechanism is an eccentric locking mechanism (11), which is disposed on the ground sleeve (7) and an eccentric head (51) of which engages with the guide passage (15) provided in the net pole (10), where it can be clamped.

* * * * *